United States Patent [19]

Thumm

[11] Patent Number: 4,554,867

[45] Date of Patent: Nov. 26, 1985

[54] METHOD AND APPARATUS FOR HANDLING A STACK OF SHEETS

[75] Inventor: Klaus A. Thumm, Phillipsburg, N.J.

[73] Assignee: Stobb, Inc., Clinton, N.J.

[21] Appl. No.: 591,279

[22] Filed: Mar. 19, 1984

[51] Int. Cl.[4] ..... B65B 13/20

[52] U.S. Cl. ..... 100/3; 53/528; 100/7; 100/26; 414/36; 414/43; 414/907

[58] Field of Search ..... 414/43, 36, 907; 53/436, 447, 526, 528, 540; 100/3, 7, 26

[56] References Cited

U.S. PATENT DOCUMENTS

| | | | |
|---|---|---|---|
| 2,705,084 | 3/1955 | Willfond | 410/34 |
| 3,739,924 | 6/1973 | Stobb | 414/43 |
| 3,771,671 | 11/1973 | Cathers | 414/43 X |
| 3,887,088 | 6/1975 | Fernandez-Rana et al. | 414/36 X |
| 3,969,993 | 7/1976 | Stobb | 414/48 |
| 4,006,576 | 2/1977 | Tetenborg | 53/528 X |
| 4,019,639 | 4/1977 | Stobb | 414/759 |
| 4,268,201 | 5/1981 | Cayton | 414/43 X |
| 4,311,090 | 1/1982 | Dudziak et al. | 100/3 |
| 4,372,201 | 2/1983 | Dudziak et al. | 100/7 |
| 4,401,021 | 8/1983 | Noll | 100/14 |
| 4,408,438 | 10/1983 | Rewitzer | 53/528 X |
| 4,416,196 | 11/1983 | yamada et al. | 100/7 |
| 4,498,381 | 2/1985 | Convey | 100/7 X |

*Primary Examiner*—Billy J. Wilhite

*Attorney, Agent, or Firm*—Arthur J. Hansmann

[57] ABSTRACT

A method and apparatus for handling a stack of sheets, including the stacking of the sheets from a continuous incoming stream of sheets and on a lower endboard, and compressing the stack and restricting the sides of the stack while the stack is moved laterally to a station where an upper endboard is applied and the stack is strapped or bound and then moved further away.

12 Claims, 6 Drawing Figures

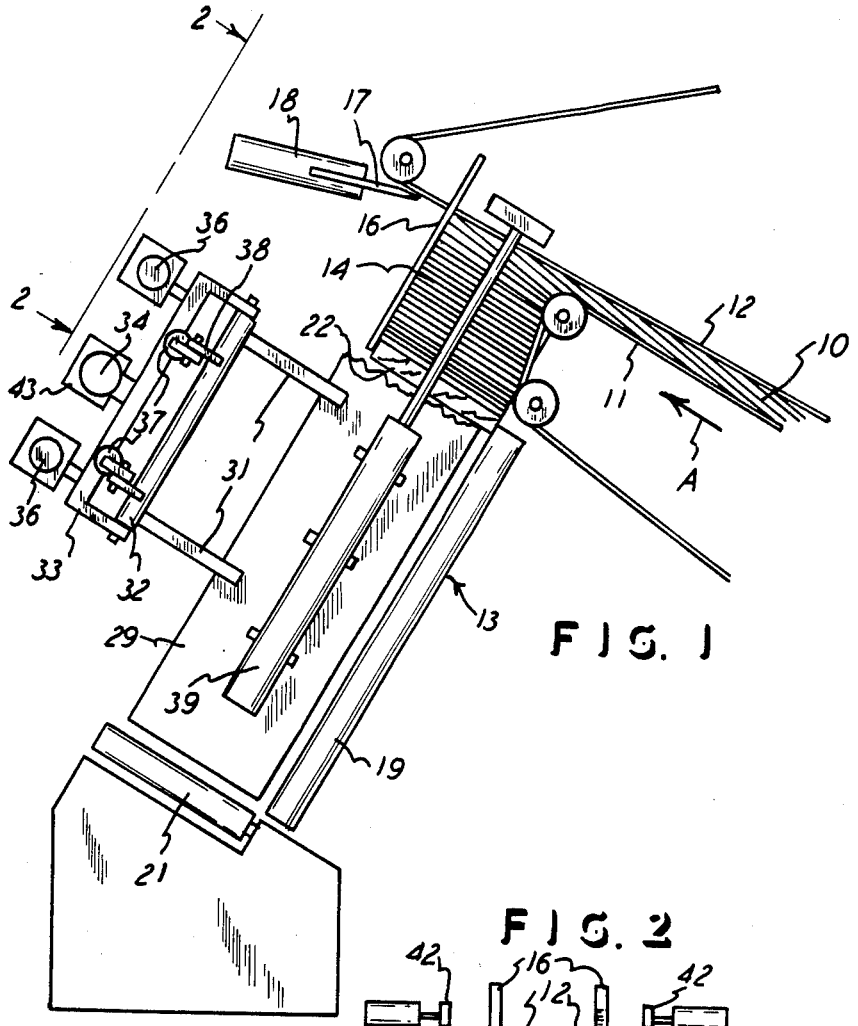
FIG. 1
FIG. 2
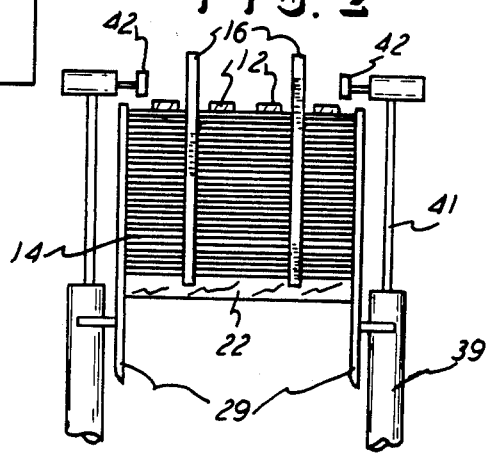

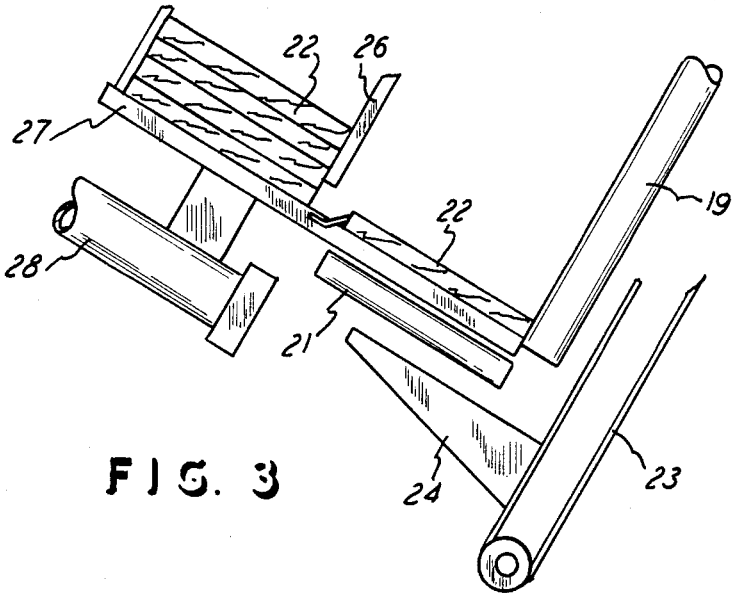
FIG. 3
FIG. 4
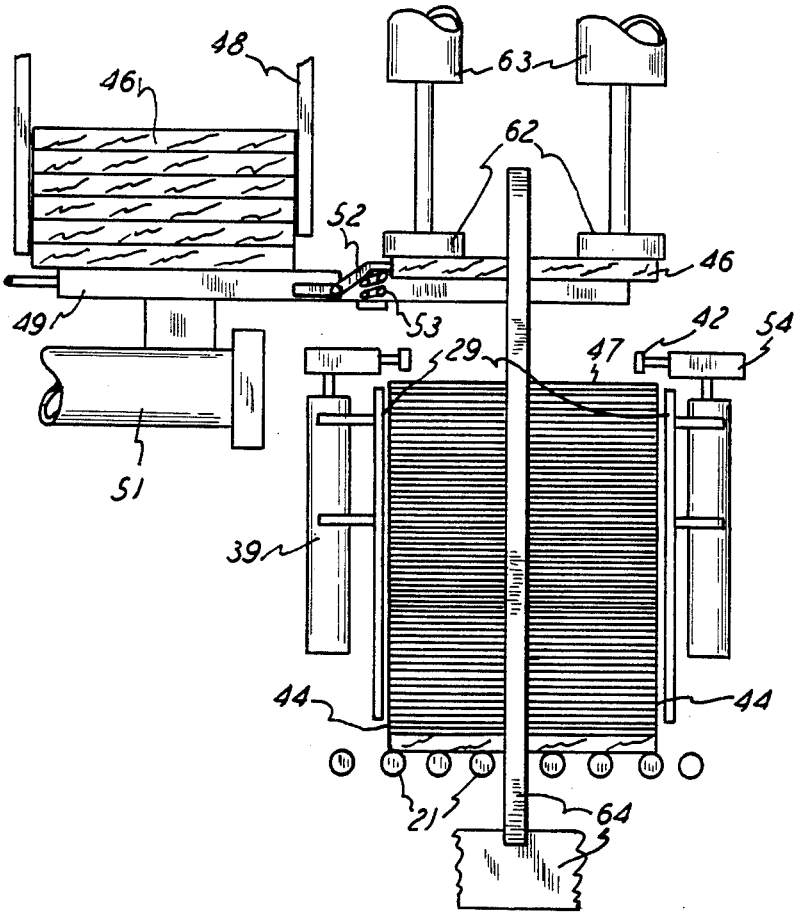
FIG. 5
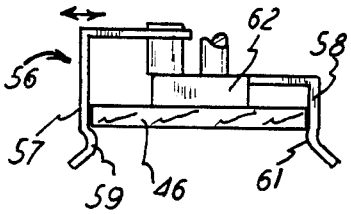

METHOD AND APPARATUS FOR HANDLING A STACK OF SHEETS

This invention relates to a method and apparatus for handling a stack of sheets, and, more particularly, it relates to forming a stack with endboards at each end, compressing the stack and binding the stack, all in an automated fashion.

BACKGROUND OF THE INVENTION

The prior art is already aware of stackers which collect signatures or sheets from a stream and form them into a stack, such as in U.S. Pat. No. 3,969,993 wherein the incoming stream of sheets continuously moves, and the stack is supported on rollers which provide some lateral or sidewise displacement of the formed stack. Further, the prior art provides tilted roller supports for lateral movement of the stack which can then be tipped or otherwise moved into a collecting or palletizing process, such as in U.S. Pat. No. 4,019,639. Still further, the prior art is also aware of the placement of endboards on opposite ends of a stack, and compressing the stack and then binding the stack, such as shown partly in U.S. Pat. Nos. 2,705,084 and 3,739,924.

The present invention improves upon the prior art by automating the stacking of a continuous stream of sheets and positioning the boards at opposite ends of the stack and compressing the stack and then tying or binding the stack with the endboards. This is accomplished by forming and maneuvering the stack on supports, such as rollers, where the stack can be continuously formed and maneuvered, from the initial stacking to the final binding, and with all performed at one location, specifically, right at the stacker itself.

A more specific object of this invention is to provide a method and apparatus for applying endboards to a stack while the stack is being handled in its initial formation and in its compressing and final binding.

BRIEF DESCRIPTION OF THE DRAWINGS

FIG. 1 is a side elevational view of an embodiment of the apparatus of this invention.

FIG. 2 is a left end elevational view of a fragment of FIG. 1, looking substantially from the line designated 2—2 in FIG. 1.

FIG. 4 is a front elevational view of some of the apparatus in FIG. 1, at the binding station.

FIG. 5 is a right end elevational view of a fragment of FIG. 4.

FIG. 6 is a top plan schematic view of this invention.

DETAILED DESCRIPTION OF THE PREFERRED METHOD AND APPARATUS

Figure 3:
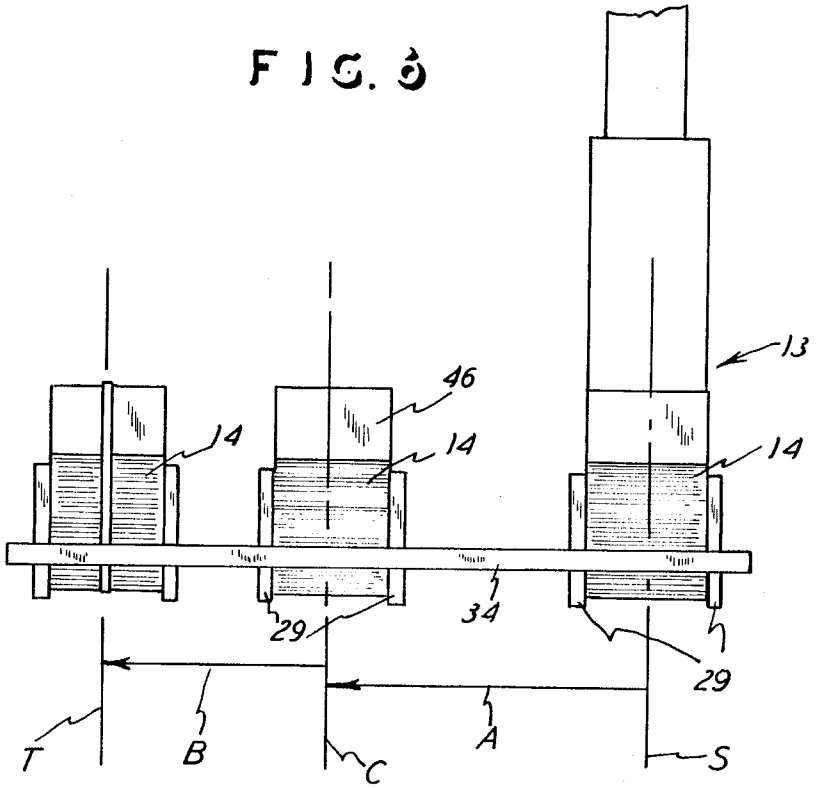
FIG. 3 is a side elevational view of a lower fragment of FIG. 1, with parts added thereto.

In describing the apparatus, such as that shown in the drawings, the method will also be inherently described. FIG. 1 shows a stream of sheets 10 moving in the direction of the arrow designated A and supported by conveyors 11 and 12. The stream 10 moves continuously throughout this entire process, and it forms a stack of sheets in a stacker generally designated 13, and a stack portion 14 is shown forming against the usual backstop 16 which is in a fixed position. Thus, the stream of imbricated sheets 10 moves toward the stacker 13 where the stream is interrupted by the backstop 16 to thus have the sheets form into the stack 14, all in a conventional arrangement. Also, when a sufficient number of sheets are formed in the stack 14, then a conventional separator plate 17, supported on a pneumatic cylinder 18, extends into the stream 10 to intercept the incoming sheets and permit the stack 14 to be completed while it is separated from the incoming stream 10. That action is understood by one skilled in the art and is accordance with U.S. Pat. No. 3,969,993, for instance.

The stack 14 is formed in an upright stance and on upright rollers 19 and substantially horizontal rollers 21, all so that the stack 14 can ultimately lean against the rollers 19 and 21 which form a right angle therebetween and which therefore fully support the stack 14 in its downward direction. FIG. 2 shows the conveyor 12 consisting of the four belts shown, for instance, and it shows the backstop 16, consisting of two spaced apart upright members against which the stream 10 is moved to form the stack 14. Also, a lower or bottom endboard 22 is shown in FIGS. 1 and 2, for serving as the base of the stack 14.

FIG. 3 shows the lower portion of the stacker 13, and it particularly shows the rollers 19 and 21 and the lower endboard 22. Stackers are also commonly provided with the upright conveyor 23 which carries the rack or support 24 upwardly, from the position shown in FIG. 3, to engage the lower endboard 22 and elevate it to the upper end of the stacker 13, that is, in the area of the conveyor 11. At that elevation, the sheets that have been preliminarily stacked on the separator plate 17 which would be extended from its position shown in FIG. 1 to receive the incoming sheets, in its conventional manner, would be transferred to the endboard 22 under the support of the rack 24 upon withdrawal of the separator plate 17, and that would be essentially the position of the endboard 22 as shown in FIG. 1. That is, in the conventional manner, the separator plate 17 temporarily receives the sheets in the incoming stream 10 and supports them in the upper end of the stacker 13 until the rack 24 with the board 22 is elevated to receive that partial stack 14. The separator plate 17 is capable of moving downwardly while the stack 14 is temporarily formed, as mentioned, and of course the rack 24 with the endboard 22 can move up and down along the upright length of the roller 19, for instance. Of course there is a row of rollers 21 in spaced apart relation, in the usual arrangement, so that the stack can be supported on at least several rollers all the time, and also so that the stack can be moved sidewise on the row of rollers 19 as well as on the row of rollers 21, such as shown in FIG. 4 with the rollers 21.

When the full stack is formed on the endboard 22, then the conveyor 23 increases its speed to lower the rack 24 and the full stack thereon down to where the board 22 is placed onto the row of rollers 21, as shown in FIG. 4. As mentioned, at that time of lowering the full stack of sheets, then the separator plate 17 is in position to intercept the following sheets from the stream 10 until the formed stack is moved sidewise out of the way, as explained later.

FIG. 3 further shows an endboard hopper 26 adjacent the stacker 13, and specifically adjacent the row of lower rollers 21. The hopper of course contains a number of endboards 22, and a reciprocating feeder 27 extends below the hopper 26 to engage the lowermost endboard 22 and move it to the position shown in FIG. 3, that is, against the row of rollers 21. Movement of the member 27 can be by means of a reciprocating cylinder 28 attached to the pusher or the like 27. Of course the pusher 27 will be retracted to the left, as viewed in FIG. 3, so that the rack 24 can be raised to pass between the rollers 21 and engage the endboard 22 and move it along the row of rollers 19 and up to the bottom of the newly forming stack 14, as indicated in FIG. 1.

The full stack in the stacker 13 is flanked by two side guides or plates 29, as shown in FIGS. 1 and 2. The two plates 29 are suspended by arms or the like 31 on a pivot roller 32 supported on a bracket 33 which in turn is connected with a reciprocating cylinder 34. Also, the bracket 33 can be guided by slide guides 36. That is, pivoting of the plates 29, in any suitable manner, can swing the plates 29 into their lateral position relative to the stack 14 for abutting the opposite sides of the stack. Such swinging action could be accomplished by means of pneumatic cylinders 37 attached to the pivot sleeve 32 through arms or links 38, for instance.

Each side gate or plate 29 carries a reciprocating cylinder 39 which has its rod 41 extending thereabove and carries a bar or the like 42. From the positions shown in FIGS. 1 and 2, contraction of the cylinders 39 will cause the bars 42 to bear downwardly on the top of the stack of sheets, and thus the sheets are initially compressed after the full stack is formed in the stacker 13, as mentioned.

In the manner described, the fully formed stack of sheets is completely controlled in that it is in a reclining angle on the rows of rollers 19 and 21, and it is flanked by the side plates 29 and is compressed downwardly by the bars 42. In that position, the full stack is moved sidewise or laterally along the row of rollers 19 and 21, by virtue of the action of the cylinder 34 supported in a frame 43. Thus the entire assembly of the side plates 29 along with their cylinders 39 and the bracket 33 and its affixed and attached parts, all move laterally, such as to the left as viewed in FIGS. 2 and 4. While FIG. 4 shows the plates 29 spaced from the stack sides 44, it will be understood that the plates 29 are in actual contact with the stack sides, as shown in FIG. 2, and FIG. 4 is shown simply for clarity of showing the stack sides 44 and the plates 29. Also, it will be understood that there can be lateral adjustment between the plates 29, such as in the bracket 33, to adjust the plates 29 toward and away from each other for the purpose of accomodating signatures of different widths, as viewed in FIG. 2.

When the stack and the transfer unit, consisting of the plates 29 and the compression bars 42, are moved to the position shown in FIG. 4, then an upper endboard 46 is applied to the top 47 of the stack. To accomplish this, an endboard hopper 48 is mounted adjacent the stacker 13 and contains a number of endboards 46 which are individually moved to positions directly above the stack, such as shown in FIG. 4, by means of a pusher arm 49 which is reciprocal through a reciprocating cylinder 51. The pusher 49 is shown to its right and fully extended position, and it has a spring finger 52 urged upwardly under the influence of a spring 53 to engage the rear edge of the board 46 when the pusher 49 is moved to the right underneath the hopper 48. In that manner, the upper endboard 46 is positioned over the stack and is ultimately applied to the top of the stack in the FIG. 4 position. Of course when the endboard 46 is applied to the stack top 47, the bars 42 are withdrawn, such as through cylinders 54, to permit the endboard 46 to rest on the stack top 47. Of course initially the bars 42 were pressing downwardly on the stack in the sidewise movement of the stack, as mentioned.

FIG. 5 shows the manner in which the top endboard 46 is held by a holder generally designated 56, and the holder includes two side spring members 57 and 58. These members have inwardly extending portions 59 and 61, respectively, which are underneath the board 46 for holding the board 46 upwardly. The holder 56 is attached to compressor heads 62 which extend down from reciprocating cylinders 63. Thus, the heads 62 move up-and-down, and the holder 56 is attached thereto and is positioned in alignment with the pusher 49 to receive the endboard 46, such as shown in FIG. 5.

When the cylinders 63 are extended further from the positions shown in FIG. 4, the endboard 46 is positioned onto the stack top 47, after the pusher 49 has been retracted to the left, as viewed in FIG. 4. Downward force of the board 46 onto the stack will cause the spring clips 57 and 58 to release the board 46.

When the board 46 is in position on the stack top 47, a stack binder 64 is operated to wrap a binding or strap around the entire stack, such as in the plane shown with the binder chute 64 in FIG. 4. That is a conventional type of stack binder which will be understood by anyone skilled in the art. After the stack is completely bound, and that action occured while the stack was being pressed by the compressor member 62, then the members 62 are retracted upwardly and the bound stack is then further moved leftward and out of position, such as by further action of the transverse cylinder 34 and the side plates 29, as previously described.

Thus, the method and apparatus provide for the continuous and automatic stacking, compressing, transfer, binding, and further transfer, of a stack, all in a non-stop manner as the stream 10 continues to move without interruption. The application of the endboards 22 and 46 is also automatic and applied, such as through unshown controls which actuate the respective pushers 27 and 49 for applying the respective endboards at the time and at the locations, as mentioned.

After the stack is delivered leftward, as viewed in FIG. 2, the transfer mechanism, which includes the side gates 29, is open, that is, the gates 29 are swung in approximately a ninety degree angle to be in the same plane. The transfer unit is then moved back to the stacker 13 and the plates 29 are swung into their parallel position as shown in FIG. 1, and the process is repeated.

FIG. 6 shows a top plan schematic view of the overall invention, and here it will be seen that the stacker 13 forms the stack 14, and the two side plates 29 flank that stack at the stacker location. Next, the stack 14 is moved leftwardly, as shown by the arrow A, and thus the stack has been moved from its center line designated S, and referring to the stacker, and it is moved to the center line designated C, and referring to the compressor. At that point the top board 46 is applied to the stack 14 and the stack is compressed while still being held by the side plates 29. Next, the stack is moved in the direction of the arrow designated B and to the strapping location, as designated by the center line labeled T. At that point, the bundle has the strap applied thereto, as shown in the sketch.

What is claimed is:

1. A method of handling a stack of sheets, comprising the steps of collecting the sheets into an inclined upright stack on its back on a stacker and on a first endboard, compressing the stack along its length and moving the stack sidewise off the stacker and while the stack is still compressed, supporting the stack and releasing stack compression and then placing a second endboard at the top of the stack while the stack is off the stacker, pressing the second endboard downwardly onto the stack, and again compressing the stack while binding the stack.

2. The method of handling a stack of sheets as claimed in claim 1, including forming the stack of sheets from a stream of incoming sheets and on the first endboard, interrupting the stream of incoming sheets by intercepting the sheets when the stack is fully formed and then lowering the stack before moving it sidewise, positioning a third endboard beneath the incoming stream and forming a second stack on the third endboard while moving and binding the first stack.

3. The method of handling a stack of sheets as claimed in claim 1, where both of the endboards are supplied from hoppers adjacent the stack and are positioned into alignment with the stack at the respective bottom and top of the stack and also with respect to the time before and after sidewise movement of the stack.

4. The method of handling a stack of sheets as claimed in claim 1, including the step of supporting the two sides of the stack which are adjacent the back of the stack while simultaneously compressing and moving the stack sidewise.

5. Apparatus for handling a stack of sheets formed from a stream of sheets, comprising a stacker for stacking the sheets in an upright stacked relation and on an endboard, side members adjacent said stacker and movable toward and away from the respective sides of the stack for abutting the stack sides, a compression member mounted on said side members and movable downwardly onto the stack for compressing the stack for compressing the stack onto said endboard, stack support means extending away from said stacker, powered means connected to said side members for moving said side members and the stack sidewise on said stack support means and to a position offset to one side of the stacker, means connected with said compression member for moving said compression member off the stack, an endboard inserter offset to the one side of said stacker for positioning an endboard on the top of the stack, a compressor offset to the one side of said stacker and operative on the stack for again compressing the stack and thereby forcing said endboards toward each other, and a strapper offset to the one side of said stacker for binding the stack while the stack is being compressed.

6. The apparatus for handling a stack of sheets formed from a stream of sheets as claimed in claim 5, including a row of rollers for supporting the stack and disposed in said stacker and extending therefrom to the one side of the stacker for the sidewise movement of the stack.

7. The apparatus for handling a stack of sheets formed from a stream of sheets as claimed in claim 6, including an endboard hopper adjacent said stacker and including a pusher member for pushing an endboard onto said stacker for supporting the stack.

8. The apparatus for handling a stack of sheets formed from a stream of sheets as claimed in claim 7, including an additional endboard hopper offset to the one side of said stacker and including a member for positioning the endboard at the top of the stack.

9. The apparatus for handling a stack of sheets formed from a stream of sheets as claimed in claim 8, including holders on said compressor for releasably holding the endboard at the top of the stack until the stack is strapped.

10. The apparatus for handling a stack of sheets as claimed in claim 5, including a guide member offset to the one side of said stacker and at the upper end of the offset stack for guiding the endboard into aligned position at the upper end of the stack.

11. The apparatus for handling a stack of sheets as claimed in claim 10, wherein said guide member is mounted on said compressor and includes a releasable holder for the endboard.

12. The apparatus for handling a stack of sheets as claimed in claim 11, wherein said releasable holder includes a spring clip for receiving the endboard.

* * * * *